US009179213B2

(12) United States Patent
Pham

(10) Patent No.: US 9,179,213 B2
(45) Date of Patent: Nov. 3, 2015

(54) SPEAKER APPARATUS FOR PRODUCING SOUND

(71) Applicant: Long Ngoc Pham, Los Angeles, CA (US)

(72) Inventor: Long Ngoc Pham, Los Angeles, CA (US)

( * ) Notice: Subject to any disclaimer, the term of this patent is extended or adjusted under 35 U.S.C. 154(b) by 299 days.

(21) Appl. No.: 13/671,442

(22) Filed: Nov. 7, 2012

(65) Prior Publication Data

US 2014/0126761 A1 May 8, 2014

(51) Int. Cl.
*H04R 1/28* (2006.01)

(52) U.S. Cl.
CPC ..... *H04R 1/2811* (2013.01)

(58) Field of Classification Search
CPC ..... H04R 1/02; H04R 1/023; H04R 1/2807; H04R 1/2811; H04R 1/2803; H04R 1/2819; H04R 1/28; H04R 1/2869; H04R 1/2815
USPC ..... 381/353, 345, 349; 181/198–199
See application file for complete search history.

(56) References Cited

U.S. PATENT DOCUMENTS

| | | | | |
|---|---|---|---|---|
| 3,371,742 | A * | 3/1968 | Norton et al. | 181/153 |
| 7,158,648 | B2 * | 1/2007 | Butters et al. | 381/160 |
| 7,450,733 | B2 * | 11/2008 | Suprapmo et al. | 381/337 |

* cited by examiner

*Primary Examiner* — Davetta W Goins
*Assistant Examiner* — Oyesola C Ojo
(74) *Attorney, Agent, or Firm* — John D. Tran; Rhema Law Group, P.C.

(57) ABSTRACT

A speaker apparatus for producing sound comprising of a housing, a plurality of covers, a speaker driver, a radiator, a resonator and a resonator stand which in combination provide an enhanced low frequency sound output.

19 Claims, 4 Drawing Sheets

SPEAKER APPARATUS FOR PRODUCING SOUND

INCORPORATION BY REFERENCE

Applicant(s) hereby incorporate herein by reference any and all U.S. patents and U.S. patent applications cited or referred to in this application.

BACKGROUND OF THE INVENTION

1. Field of the Invention

Aspects of this invention relate generally to a speaker apparatus for producing sound and more particularly, to a speaker apparatus and method which enhances low frequency sound output in a mobile speaker device format.

2. Description of Related Art

The following art defines the present state of this field:

Currently there are no known speaker apparatus for producing sound or corresponding methods that have the ability to enhance low frequency sound output in a mobile speaker device format.

SUMMARY OF THE INVENTION

Modernly, electronic devices such as laptops, mobile phones, tablets have increasingly become popular with the consumers due to the portability of such devices and ability for these types of mobile devices to handle a wide range of multi-tasks from running work related applications to becoming an entertainment consumption device which allows consumers, among other things, to watch movies and listen to music.

With recent technological advancements, these electronic devices have become thinner and smaller which increases portability and convenience. Often times, however, certain sacrifices must be made in regards to these electronic devices to allow them to be thin and compact. For example, some popular thin laptops do not include a built-in cd/dvd rom drive which would increase the size of the laptop. Another example is that a majority, if not all of these portable electronic devices have small speaker systems which have poor frequency response including low frequency or bass response. The reason is because typically in order to have good sound frequency response, there must be larger speakers which produce a wider range of frequencies and typically an amp which powers the speakers to allow for louder sounds. In particular, often times it is necessary to have large sub-speakers or sub-woofers in order to obtain good performance in low frequencies which result in good bass response. As a result of the increased attention to size and weight, a majority if not all of the aforementioned mobile electronic devices have small or non-existent speakers and sub-woofers which result in poor overall sound quality especially at low frequencies leading to poor bass response performance. Especially when consuming entertainment media such as watching a movie or listening to music, the poor speaker performance, in particular in the low bass frequency range, decreases the enjoyment of the media and does not allow the entertainment media to be fully enjoyed as it was meant to be.

To compensate for the poor speaker performance in the above mobile entertainment devices, many people use portable/mobile speakers which attach to their mobile entertainment devices either wired or wirelessly to enhance the speaker performance of their mobile entertainment devices. These types of portable/mobile speakers can come in a variety of shapes and sizes but the smaller more portable mobile speakers often also suffer the same limitations as the mobile entertainment devices stated above.

Therefore, there is a need in the industry for a small format speaker apparatus for producing sound that enhances low frequency sound output.

Aspects of the present invention teach certain benefits in construction and use which give rise to the exemplary advantages described below.

In an exemplary embodiment of the invention, a mobile speaker device comprising generally a speaker driver, a plurality of covers, a radiator, stand for radiator, a resonator and stand for resonator.

A primary objective inherent in the present invention and method of use is to provide advantages not taught by the prior art.

Another objective inherent in the present invention and method of use is to provide a speaker apparatus for producing sound in a limited physical space which allows for sound quality, in particular low frequency sound output, that is unrivaled and unlike any other current speaker apparatus devices.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Figure 1:
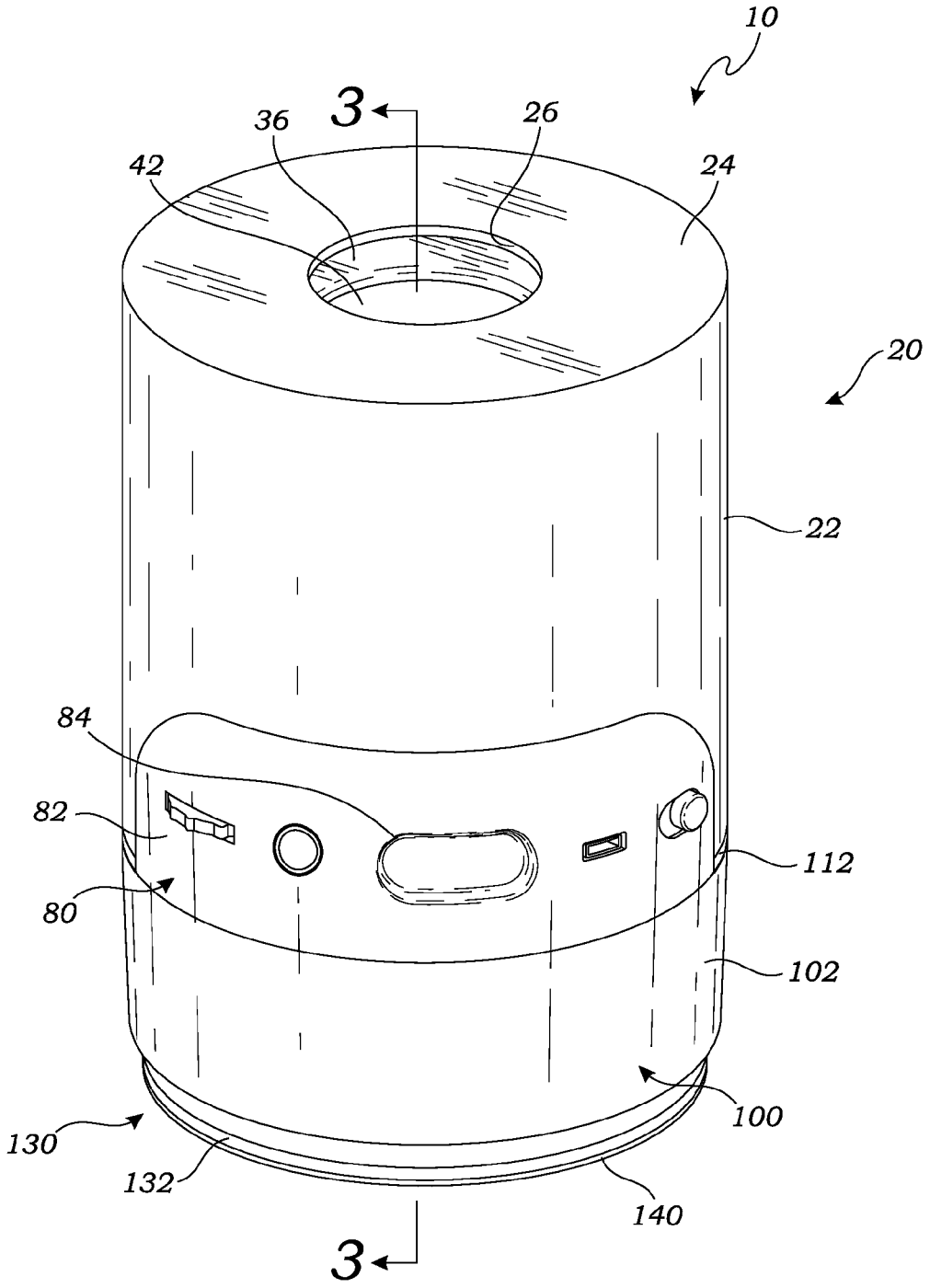
FIG. 1 is a perspective view of an exemplary embodiment of the inventive subject matter.

As shown in FIG. 1, there is shown a perspective view of an exemplary embodiment of a speaker apparatus for producing sound 10 comprising a housing 20, a housing annular wall 22, a housing upper wall 24, a housing upper wall opening 26, a first cover upper wall opening 36 and a driver cover 42. The exemplary embodiment also comprising of a third wall 80, a third cover annular wall 82, a third cover annular wall opening 84, a fourth cover 100, a fourth cover annular wall 102, and a light cover perimeter flange 112. In a preferred embodiment, the speaker apparatus for producing sound 10 also comprising a resonator stand 130, a resonator stand base 132, and a pad 140. In one preferred embodiment the sound may travel through the speaker apparatus 10 through the top and bottom of the apparatus and the speaker apparatus 10 is compact and portable which may be connected to a mobile device wired through a standard cable or wirelessly through industry standard proprietary open wireless technology such as short-wavelength radio transmissions or through the internet wirelessly.

Figure 2:
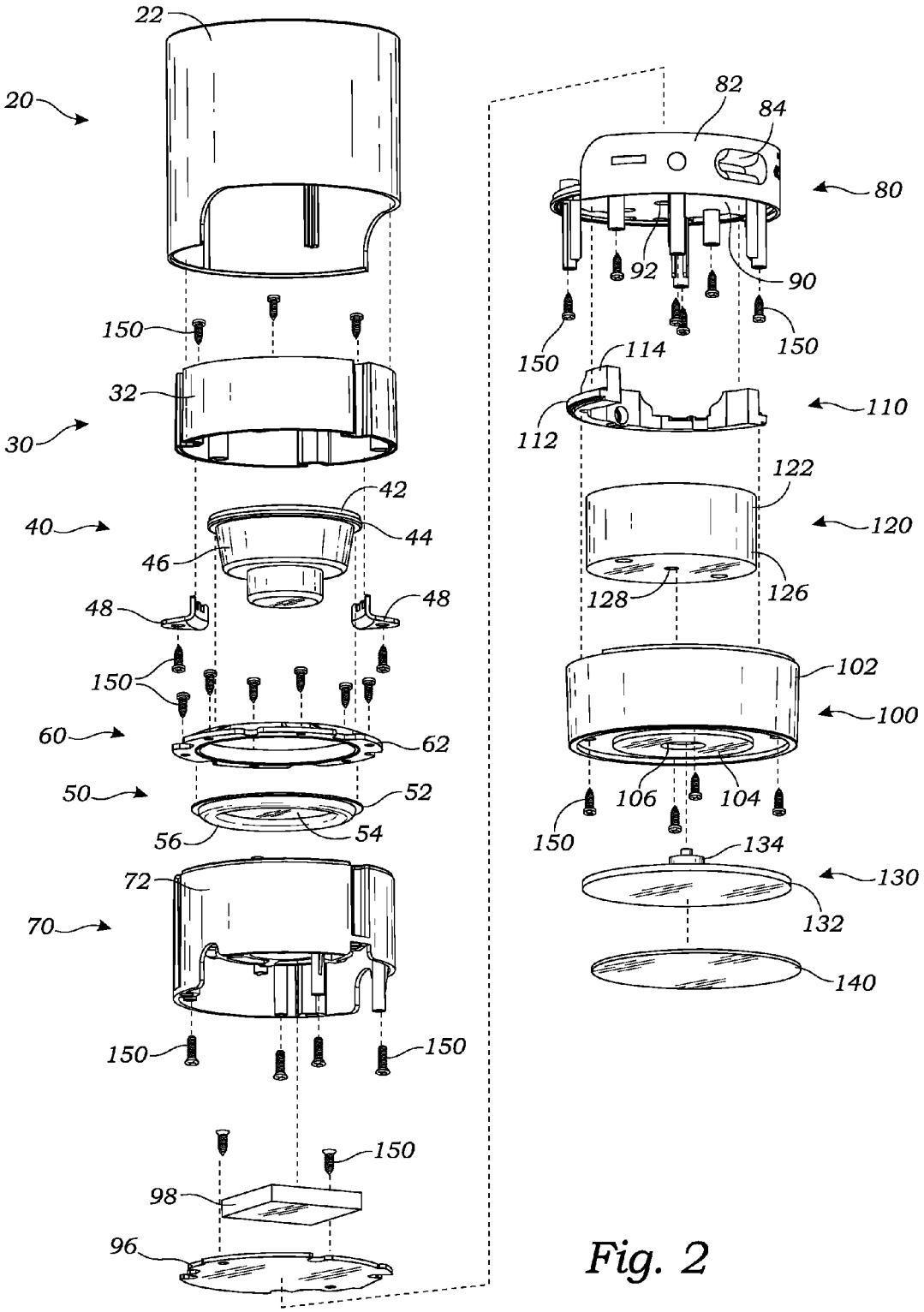
FIG. 2 is an exploded view of an exemplary embodiment of the inventive subject matter.

Turning to FIG. 2, an exploded view of the speaker apparatus for producing sound 10 is shown comprising of a housing 20, housing annular wall 22, a first cover 30, a first cover annular wall 32, a speaker driver 40, a speaker driver cover 42, a speaker driver flange 44, a speaker driver body 46, a plurality of mounting brackets 48, a radiator 50, a radiator flange 52, a radiator membrane 54, a radiator lip 56, a radiator stand 60, a radiator stand flange 62, a second cover 70, a second cover annular wall 72, a third cover 80, a third cover annular wall 82, a third cover annular wall opening 84, a third cover lower wall 90, a third cover lower wall opening 92, a printed circuit board (PCB) 96, a battery 98, a fourth cover 100, a fourth cover annular wall 102, a fourth cover lower wall 104, a fourth cover lower wall opening 106, a light cover 110, a light cover perimeter flange 112, a light cover annular wall 114, a resonator 120, a resonator annular surface 122, a resonator lower surface 126, a resonator bore 128, a resonator stand 130, a resonator stand base 132, a pad 140 and a plurality of screws 150. In an exemplary embodiment, the speaker driver 40 may be comprised of a group selected from neodymium (Nd), ferrite (Fe) and boron (B). In one preferred embodiment of the speaker apparatus for producing sound 10 comprises of just one speaker driver 40 which retains the desired compact size and portability of the speaker apparatus 10. However, even though the speaker apparatus 10 of the present invention contains only one speaker drive, it still possesses great sound quality because as part of the inventive subject matter of the present invention the speaker apparatus for producing sound 10 uses the PCB 96 to combine the left and right channels together resulting in a mono stereo sound. In one preferred embodiment, the PCB 96 is connected electronically to the speaker driver 40 and the resonator 120 and contains a plurality of amplifiers which drive the resonator 120 and the speaker driver 40 separately which results in louder sound output and improves the overall sound quality of the speaker apparatus 10. In one exemplary embodiment, a battery 98 is electrically installed on the PCB 96 which provides power to the speaker apparatus 10.

Unlike other smaller compact mobile speaker devices, the speaker apparatus for producing sound 10 of the present invention comprises a full range speaker driver 40 which reproduces as much of the audible frequency range as possible, within the limitations, imposed by the physical constraints of the inventive subject matter design. In one preferred embodiment, the speaker driver 40 produces a sound frequency range of above 100 Hz and the resonator 120 produces a sound frequency in a range between 20 Hz-500 Hz which provides enhances low frequency response but also enhances the sound frequencies produced by the speaker driver 40. In a preferred embodiment, the resonator 120 and the radiator 50 cooperate with the speaker driver 40 to enhance the low frequency range output, typically below 60 Hz, of the speaker apparatus 10. In one preferred embodiment, the radiator 50 is comprised of iron (Fe) which helps the sound frequencies produced by the speaker driver 40 and the resonator 120 travel throughout the speaker apparatus 10.

Figure 3:
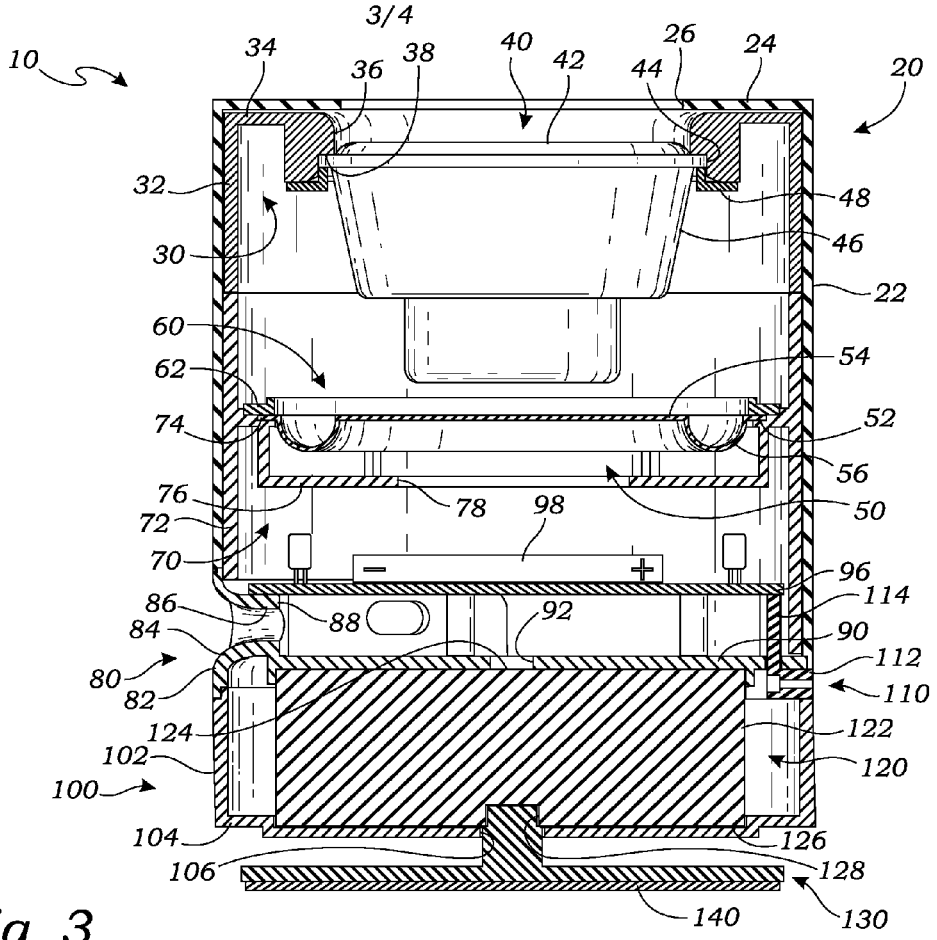
FIG. 3 is a cross sectional view of an exemplary embodiment of the inventive subject matter shown in FIG. 1.

FIG. 3 depicts a cross sectional view of the speaker apparatus for producing sound 10 when fully assembled. In particular, the speaker apparatus 10 contains a housing 20 which comprises of a housing annular wall 22 which has an housing annular wall opening 26 which allows the sound to travel from the speaker driver 40 upwards and through the upper housing annular wall opening 26. A first cover 30 is seated within the housing 20 such that the first cover upper wall 34 is substantially adjacent to the housing upper wall 24 and the first cover upper wall opening 36 is substantially aligned with the housing upper wall opening 26. Additionally, a speaker driver 40 having a radially-outwardly extending speaker driver flange 44 is seated within the first cover recess 38 wherein the speaker driver 40 further having a speaker driver body 46 that extends and is suspended substantially within the first cover 30. Moving down FIG. 3, when fully assembled, the speaker apparatus 10 contains a third cover 80 comprising of a third lower wall 90 wherein the third cover 80 is seated so as to at least partially be within the housing 20 and partially abut the housing 20. A forth cover 100 having a fourth cover lower wall 104 is shown wherein the fourth cover lower wall 104 having a fourth cover lower wall opening 106 and the fourth cover 100 is seated so as to at least partially abut the third cover 80.

Figure 4:
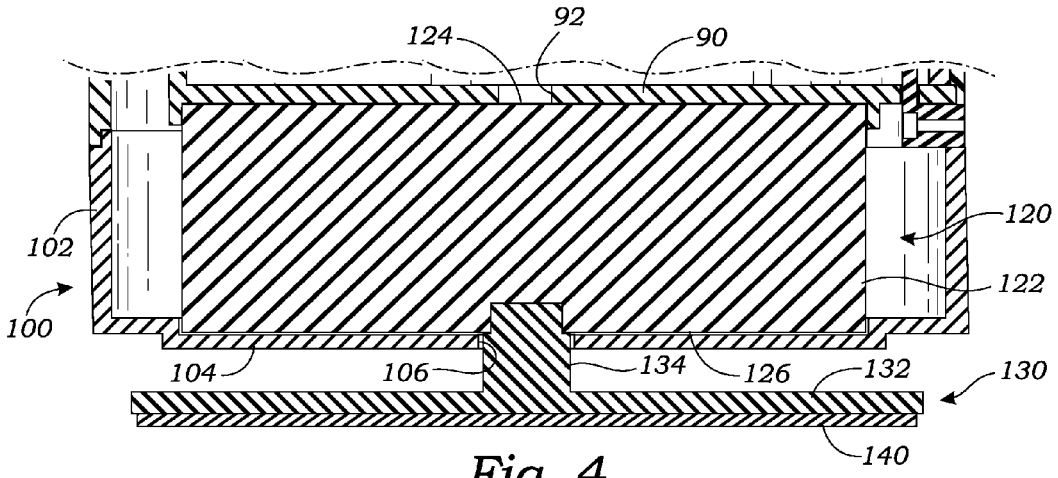
FIG. 4 is a blown up cross sectional view of the resonator component of the exemplary embodiment of the inventive subject matter.

FIG. 4 shows a close up of view of the resonator 120 as seen in FIG. 3 which is clearly seated between the third and fourth covers respectively (80, 100). The resonator 120 having a resonator upper surface 124 substantially adjacent to the third cover lower wall 90 wherein the resonator 120 further having a resonator bore 128 formed in the resonator lower surface 126. Also seen is a resonator stand 130 having a resonator stand base 132 and a resonator stem 134 extending substantially upwardly therefrom, the resonator stand stem 134 passing through the fourth cover lower wall opening 106 and seating within the resonator bore 128 whereby operation of the speaker apparatus 10 results in electrical activation of the resonator 120 transmitted from the resonator 120 through the resonator stand 130 to a surface the speaker apparatus 10 is sitting on, such that the resonator 120 enhances low frequency sound output. As a result in one preferred embodiment, the radiator stand 130 acts as a conduit for the low frequency sound energy to travel from the resonator to the actual surface thereby enhancing the low frequency sound output via the surface response. However, one can appreciate that the speaker apparatus 10 contains a third cover annular wall opening 84 which serves as an "air hole" which also serves to allow the low frequency sound output to travel out from the air hole whereby the speaker apparatus 10 still produces a low frequency sound output without requiring a surface for the speaker apparatus 10 to be positioned on. In addition, the radiator 50 comprises of a radiator membrane 54 and a radiator flange 52 extending radially outwardly therefrom wherein the radiator 50 is seated within the second cover 70 such that the radiator flange 52 substantially abuts the second cover flange 74 whereby operation of the speaker apparatus 10 further results in mechanical activation of the radiator 50 as sound from the driver resonates within the first and second covers (30, 70) and vibrates the radiator membrane 54, such that the radiator 50 and the resonator 120 cooperate with the driver to enhance low frequency sound output.

Figure 5:
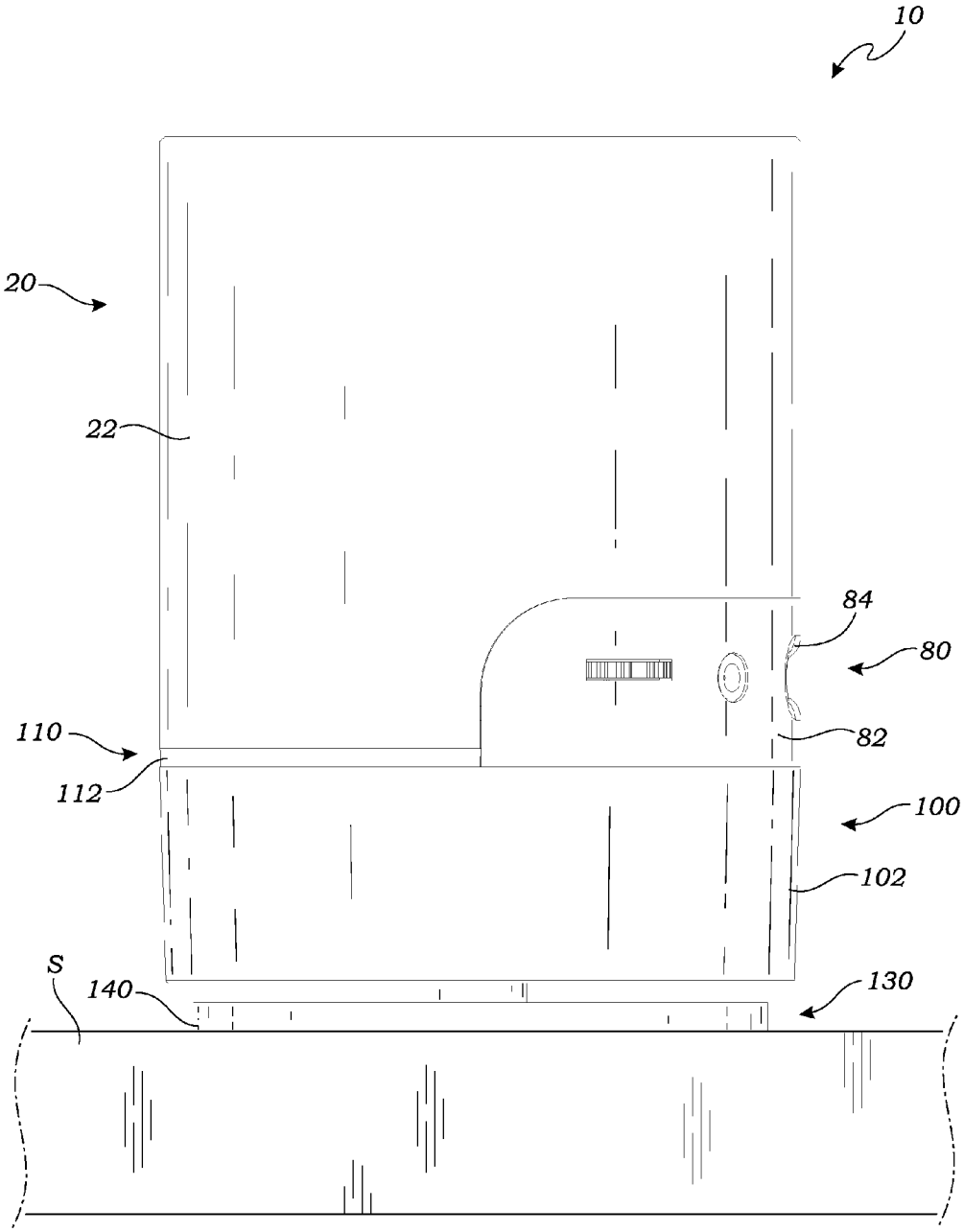
FIG. 5 is a side view of an alternate exemplary embodiment of the inventive subject matter positioned on a surface.

Turning to FIG. 5, a fully assembled speaker apparatus for producing sound 10 is shown sitting on top of a surface S. An important inventive aspect of the speaker apparatus 10 is the position of the speaker driver 40 and the resonator 120 which allows the higher sound frequencies of the speaker driver 40 to travel up and through the top housing upper wall opening 26 and allows the lower frequency output to travel down and through the fourth cover lower wall opening 106. Practically, this provides the user to feel the bass response from the speaker apparatus 10 because of the surface S reflecting and further enhancing the already enhanced low frequency sound output created by the combination of the speaker driver 40, the radiator 50, the resonator 120 and the resonator stand 130 operating together yet also enjoy the higher frequencies of the speaker driver 40 simultaneously. The combination of the speaker driver 40, the radiator 50 and the resonator 120 in a compact and portable configuration as embodied in the speaker apparatus 10 thus provides for sounds quality especially enhanced low frequency output that is unrivaled and never seen or heard before in a mobile speaker device such as the inventive subject matter of the speaker apparatus for producing sound 10. In one preferred embodiment, in addition to the sound conduit properties the resonator stand 130 allows for a stable base for the speaker apparatus 10 by providing some flexibility by the resonator stand stem 134 to absorb and flex to prevent the speaker apparatus 10 from physically moving on the surface because of the enhanced low frequency sound output generated by the speaker apparatus 10. In one preferred embodiment, a pad 140 made out of rubber or similar pliable material is attached to the bottom of the resonator stand base 132 which further prevents unwanted movement of the speaker apparatus 10 on a surface S.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

The invention claimed is:

1. A speaker apparatus for producing sound, comprising:

a housing having a housing upper wall, the housing upper wall having a housing upper wall opening;

a first cover having a first cover upper wall having a first cover upper wall opening, the first cover upper wall terminating radially inwardly in a substantially annular downwardly-opening first cover recess, the first cover seated within the housing such that the first cover upper wall is substantially adjacent to the housing upper wall and the first cover upper wall opening is substantially aligned with the housing upper wall opening;

a driver having a radially-outwardly extending driver flange seated within the first cover recess, the driver further having a driver body that extends and is suspended substantially within the first cover;

a third cover having a third cover lower wall, the third cover seated so as to at least partially be within the housing and partially abut the housing;

a fourth cover having a fourth cover lower wall, the fourth cover lower wall having a fourth cover lower wall opening, the fourth cover seated so as to at least partially abut the third cover;

a resonator seated between the third and fourth covers, the resonator having a resonator upper surface substantially adjacent to the third cover lower wall and having a resonator lower surface substantially adjacent to the fourth cover lower wall, the resonator further having a resonator bore formed in the resonator lower surface; and a resonator stand having a resonator stand base and a resonator stand stem extending substantially upwardly therefrom, the resonator stand stem passing through the fourth cover lower wall opening and seating within the resonator bore, whereby operation of the speaker apparatus results in electrical activation of the resonator transmitted from the resonator through the resonator stand to a surface the speaker apparatus is sitting on, such that the resonator enhances low frequency sound output.

2. The apparatus of claim 1 further comprising:

a second cover having a second cover flange extending radially inwardly therefrom, the second cover flange having a second cover stepped wall connected thereto, the second cover stepped wall having a second cover stepped wall opening, the second cover substantially abutting the first cover; and a radiator having a radiator membrane and a radiator flange extending radially outwardly therefrom, the radiator seated within the second cover such that the radiator flange substantially abuts the second cover flange, whereby operation of the speaker apparatus further results in mechanical activation of the radiator as sound from the driver resonates within the first and second covers and vibrates the radiator membrane, such that the radiator and resonator cooperate with the driver to enhance low frequency sound output.

3. The apparatus of claim 2 wherein the radiator further has a downwardly-projecting substantially annular lip formed between the radiator membrane and the radiator flange.

4. The apparatus of claim 2 further comprising a radiator stand having a radially-outwardly-extending radiator stand flange, the radiator stand seated over the radiator within the second cover such that the radiator stand flange substantially abuts the radiator flange and the second cover flange.

5. The apparatus of claim 1 wherein:

the housing has a housing annular wall connected to the housing upper wall;

the first cover has a first cover annular wall connected to the first cover upper wall such that the first cover annular wall is substantially adjacent to the housing annular wall;

the second cover has a second cover annular wall having the second cover flange extending radially inwardly therefrom, the second cover annular wall being substantially adjacent to the housing annular wall;

the third cover has a third cover annular wall connected to the third cover lower wall and to a third cover upper wall spaced from the third cover lower wall, the third cover upper wall having a third cover upper wall opening, the third cover annular wall being formed in the portion thereof abutting the housing with a third cover annular wall opening in communication with the space between the third cover upper wall and the third cover lower wall; and the fourth cover has a fourth cover annular wall connected to the fourth cover lower wall.

6. The apparatus of claim 5 wherein:

a semi-circular light cover having a light cover annular wall connected to a radially-outwardly extending light cover perimeter flange is seated so as to at least partially abut the third cover and the housing; and the fourth cover is seated so as to at least partially abut the light cover.

7. The apparatus of claim 1 further comprising a mounting bracket installed on the first cover upper wall so as to secure the driver flange in position within the first cover recess.

8. The apparatus of claim 1 further comprising:

a printed circuit board seated on the third cover so as to at least partially abut the third cover upper wall, the printed circuit board being electrically connected to the driver and the resonator; and a battery electrically installed on the printed circuit board.

9. The apparatus of claim 1 further comprising a pad installed on the resonator stand base so as to be in contact with the surface.

10. A speaker apparatus for producing sound, comprising:

a first cover having a first cover annular wall connected to a first cover upper wall, the first cover upper wall having a first cover upper wall opening terminating radially inwardly in a substantially annular downwardly-opening first cover recess;

a driver having a radially-outwardly extending driver flange seated within the first cover recess, the driver further having a driver body that extends and is suspended substantially within the first cover;

a second cover having a second cover annular wall and a second cover flange extending radially inwardly therefrom, the second cover flange having a second cover stepped wall connected thereto, the second cover stepped wall having a second cover stepped wall opening, the second cover substantially abutting the first cover;

a radiator having a radiator membrane and a radiator flange extending radially outwardly therefrom, the radiator seated within the second cover such that the radiator flange substantially abuts the second cover flange;

a third cover having a third cover annular wall connected to a third cover lower wall, the third cover lower wall having a third cover lower wall opening;

a fourth cover having a fourth cover annular wall connected to a fourth cover lower wall, the fourth cover lower wall having a fourth cover lower wall opening, the fourth cover seated so as to at least partially abut the third cover;

a resonator seated between the third and fourth covers, the resonator having a resonator upper surface substantially adjacent to the third cover lower wall and having a resonator lower surface substantially adjacent to the fourth cover lower wall, the resonator further having a resonator bore formed in the resonator lower surface; and a resonator stand having a resonator stand base and a resonator stand stem extending substantially upwardly therefrom, the resonator stand stem passing through the fourth cover lower wall opening and seating within the resonator bore, whereby operation of the speaker apparatus results in mechanical activation of the radiator as sound from the driver resonates within the first and second covers and vibrates the radiator membrane and further results in electrical activation of the resonator transmitted from the resonator through the resonator stand to a surface the speaker apparatus is sitting on, such that the radiator and resonator cooperate with the driver to enhance low frequency sound output.

11. The apparatus of claim 10 further comprising a housing having a housing annular wall connected to a housing upper wall, the housing upper wall having a housing upper wall opening, wherein:

the first cover is seated within the housing such that the first cover annular wall is substantially adjacent to the housing annular wall, the first cover upper wall is substantially adjacent to the housing upper wall, and the first cover upper wall opening is substantially aligned with the housing upper wall opening; and the second cover is seated within the housing substantially abutting the first cover such that the second cover annular wall is substantially adjacent to the housing annular wall.

12. The apparatus of claim 11 wherein:

the third cover further has a third cover upper wall spaced from the third cover lower wall and having a third cover upper wall opening; and the third cover is seated so as to at least partially be within the housing and partially abut the housing, the third cover annular wall being formed in the portion thereof abutting the housing with a third cover annular wall opening in communication with the space between the third cover upper wall and the third cover lower wall.

13. The apparatus of claim 11 wherein:

a semi-circular light cover having a light cover annular wall connected to a radially-outwardly extending light cover perimeter flange is seated so as to at least partially abut the third cover and the housing; and the fourth cover is seated so as to at least partially abut the light cover.

14. The apparatus of claim 10 further comprising a mounting bracket installed on the first cover upper wall so as to secure the driver flange in position within the first cover recess.

15. The apparatus of claim 10 wherein the radiator further has a downwardly-projecting substantially annular lip formed between the radiator membrane and the radiator flange.

16. The apparatus of claim 10 further comprising a radiator stand having a radially-outwardly-extending radiator stand flange, the radiator stand seated over the radiator within the second cover such that the radiator stand flange substantially abuts the radiator flange and the second cover flange.

17. The apparatus of claim 10 further comprising:

a printed circuit board seated on the third cover so as to at least partially abut the third cover upper wall, the printed circuit board being electrically connected to the driver and the resonator; and a battery electrically installed on the printed circuit board.

18. The apparatus of claim 10 further comprising a pad installed on the resonator stand base so as to be in contact with the surface.

19. A speaker apparatus for producing sound, comprising:

a housing having a housing annular wall connected to a housing upper wall, the housing upper wall having a housing upper wall opening;

a first cover having a first cover annular wall connected to a first cover upper wall, the first cover seated within the housing such that the first cover annular wall is substantially adjacent to the housing annular wall and the first cover upper wall is substantially adjacent to the housing upper wall, the first cover upper wall having a first cover upper wall opening configured to be substantially aligned with the housing upper wall opening and terminating radially inwardly in a substantially annular downwardly-opening first cover recess;

a driver having a radially-outwardly extending driver flange seated within the first cover recess, the driver further having a driver body that extends and is suspended substantially within the first cover;

a mounting bracket installed on the first cover upper wall so as to secure the driver flange in position within the first cover recess;

a second cover having a second cover annular wall and a second cover flange extending radially inwardly therefrom, the second cover flange having a second cover stepped wall connected thereto, the second cover stepped wall having a second cover stepped wall opening, the second cover seated within the housing substantially abutting the first cover such that the second cover annular wall is substantially adjacent to the housing annular wall;

a radiator having a radiator membrane and a radiator flange extending radially outwardly therefrom, the radiator seated within the second cover such that the radiator flange substantially abuts the second cover flange, the radiator further having a downwardly-projecting substantially annular lip formed between the radiator membrane and the radiator flange;

a radiator stand having a radially-outwardly-extending radiator stand flange, the radiator stand seated over the radiator within the second cover such that the radiator stand flange substantially abuts the radiator flange and the second cover flange;

a third cover having a third cover annular wall connected to a third cover upper wall and a spaced-apart third cover lower wall, the third cover upper wall having a third cover upper wall opening and the third cover lower wall having a third cover lower wall opening, the third cover seated so as to at least partially be within the housing and partially abut the housing, the third cover annular wall being formed in the portion thereof abutting the housing with a third cover annular wall opening in communication with the space between the third cover upper wall and the third cover lower wall;

a semi-circular light cover having a light cover annular wall connected to a radially-outwardly extending light cover perimeter flange, the light cover seated so as to at least partially abut the third cover and the housing;

a printed circuit board seated on the third cover so as to at least partially abut the third cover upper wall and the light cover annular wall, the printed circuit board being electrically connected to at least the driver;

a battery electrically installed on the printed circuit board;

a fourth cover having a fourth cover annular wall connected to a fourth cover lower wall, the fourth cover lower wall having a fourth cover lower wall opening, the fourth cover seated so as to at least partially abut the third cover and the light cover;

a resonator seated between the third and fourth covers, the resonator having a resonator upper surface substantially adjacent to the third cover lower wall and having a resonator lower surface substantially adjacent to the fourth cover lower wall, the resonator further having a resonator bore formed in the resonator lower surface;

a resonator stand having a substantially annular resonator stand base and a resonator stand stem extending substantially upwardly therefrom, the resonator stand stem passing through the fourth cover lower wall opening and seating within the resonator bore, the resonator being electrically connected to the printed circuit board; and a pad installed on the resonator stand base, whereby operation of the speaker apparatus results in mechanical activation of the radiator as sound from the driver resonates within the first and second covers and vibrates the radiator membrane as facilitated by the radiator lip and further results in electrical activation of the resonator transmitted from the resonator through the resonator stand and pad to a surface the speaker apparatus is sitting on, such that the radiator and resonator cooperate with the driver to enhance low frequency sound output.

* * * * *